United States Patent [19]

Kourimsky

[11] Patent Number: 5,035,638

[45] Date of Patent: Jul. 30, 1991

[54] ELECTRICAL TERMINAL WHICH HAS MEANS TO PROVIDE A RELIABLE ELECTRICAL CONNECTION

[75] Inventor: Friedrich A. J. Kourimsky, Bensheim, Fed. Rep. of Germany

[73] Assignee: AMP Incorporated, Harrisburg, Pa.

[21] Appl. No.: 568,005

[22] Filed: Aug. 16, 1990

[51] Int. Cl.[5] ..... H01R 4/70

[52] U.S. Cl. ..... 439/275; 439/750

[58] Field of Search ..... 439/274, 275, 279, 750, 439/587–589

[56] References Cited

U.S. PATENT DOCUMENTS

| | | | |
|---|---|---|---|
| 2,945,203 | 7/1980 | Quackenbush | 439/589 |
| 3,085,138 | 4/1963 | Brown et al. | 439/750 |
| 4,214,802 | 7/1980 | Otani et al. | 439/275 |
| 4,560,219 | 12/1985 | Chapelot | 439/587 |
| 4,643,506 | 2/1987 | Kobler | 439/347 |
| 4,707,045 | 11/1987 | Ney et al. | 439/588 |

FOREIGN PATENT DOCUMENTS

| | | | |
|---|---|---|---|
| 2543369 | 9/1984 | France | 439/750 |

*Primary Examiner*—Gary F. Paumen

*Attorney, Agent, or Firm*—Bruce J. Wolstoncroft

[57] ABSTRACT

An electrical connector (2) has terminal receiving cavities (48) in which are provided terminals (4). Each terminal (4) has a mating end (10, 12) and a conductor receiving end (26) for receipt of a conductor (6) therein. The terminals have insulating cover means (8) which are positioned over the conductor receiving ends (26). The insulating cover means are secured to the terminals by securing means (22) which are integrally attached to the terminals. The configuration of the insulating cover means is such to eliminate air voids provided in the terminal receiving cavities (48) of the connector (2), thereby protecting the terminals from the corrosion which can occur due to the moisture provided in the air voids condensing when the connector is exposed to temperature fluctuation.

9 Claims, 3 Drawing Sheets

ELECTRICAL TERMINAL WHICH HAS MEANS TO PROVIDE A RELIABLE ELECTRICAL CONNECTION

FIELD OF THE INVENTION

The invention relates to an electrical terminal which has a type of sealing means provided thereon. In particular, the electrical terminal has a dielectric material which surrounds the electrical interconnection between the terminal and the cable, to prevent moisture from harming the electrical characteristics of the cable. In order to operate effectively, the dielectric material will cooperate with a terminal receiving cavity into which the terminal is inserted, thereby minimizing the air voids which are provided in the cavity.

BACKGROUND OF THE INVENTION

Electrical connectors are known which receive in terminal receiving cavities thereof one or more electrical conductors having terminals terminated on ends thereof. Many of the terminals have wire seals which are disposed around each electrical conductor at the rearward end of the connector to provide a sealing arrangement between the conductor and the connector housing. One such connector is disclosed in U.S. Pat. No. 4,643,506, in which the conductor is sealingly engaged at locations forwardly and rearwardly from the location where the wire seal sealingly engages the sidewalls of the rearward cavity portion.

Sealing of the conductors is required when the terminals must be isolated from the surroundings. However, it is not required, nor is it practical in all situations to environmentally seal the conductors. In the alternative, if no type of sealing is provided, the air voids provided in the terminal receiving cavities can cause damage to the electrical connection which is effected between the terminals and the conductors. This is a particular problem when the connector is provided in an environment which has frequent temperature changes. As the temperature is reduced, the moisture provided in the air voids condenses onto the terminals and the conductors. The presence of moisture on the surfaces causes the deterioration of the terminals and the conductors, which results in an unreliable and essentially ineffective electrical connection between the respective terminal and conductors.

Consequently, in instances in which it is impractical or impossible to provide an effective wire seal, as was described, it would be beneficial to provide some type of protection to the area in which the electrical connection is effected. The protection should prevent the condensation of the moisture on the surfaces of the terminals and conductors, thereby insuring that the electrical connection between the terminals and the conductors is reliable over time.

SUMMARY OF THE INVENTION

The invention is directed to an electrical terminal for use in the termination of an electrical conductor. The electrical terminal has a first end and an opposed second end. A mating portion of the terminal is positioned proximate the first end of the terminal, and a conductor engaging portion is provided proximate the second end of the terminal. The conductor engaging portion has a conductor crimping means which cooperates with the conductor to provide the electrical interconnection between the conductor and the terminal.

The electrical terminal is characterized in that an insulating cover means is provided which extends over the conductor engaging portion of the terminal. The insulating cover means has an opening provided therein which allows the electrical conductor and conductor crimping means to be positioned in the opening, such that moisture condensation is prevented from forming on the electrical conductor and the conductor crimping means.

Securing means are provided on the electrical terminal. The securing means cooperate with the insulating cover means to maintain the insulating cover means in cooperation with the conductor crimping means.

An object of the invention is to provide a means to protect the terminal from corrosion due to moisture condensation which can occur due to temperature fluctuation. In order to accomplish this, it is important that the volume of air, which is provided in terminal receiving cavities of known connectors, be replaced by some other material.

Another object of the invention is to provide an easily installable and cost effective means to eliminate the air voids present in terminal receiving cavities. Utilizing the teaching of the present invention, the means to protect the terminals are installed on the terminals as the terminals are assembled to the conductors. This process allows for ease of handling and manipulation.

BRIEF DESCRIPTION OF THE DRAWINGS

An embodiment of the invention will now be described by way of example with reference to the accompanying drawings, in which.

DETAILED DESCRIPTION OF THE INVENTION

Figure 1:
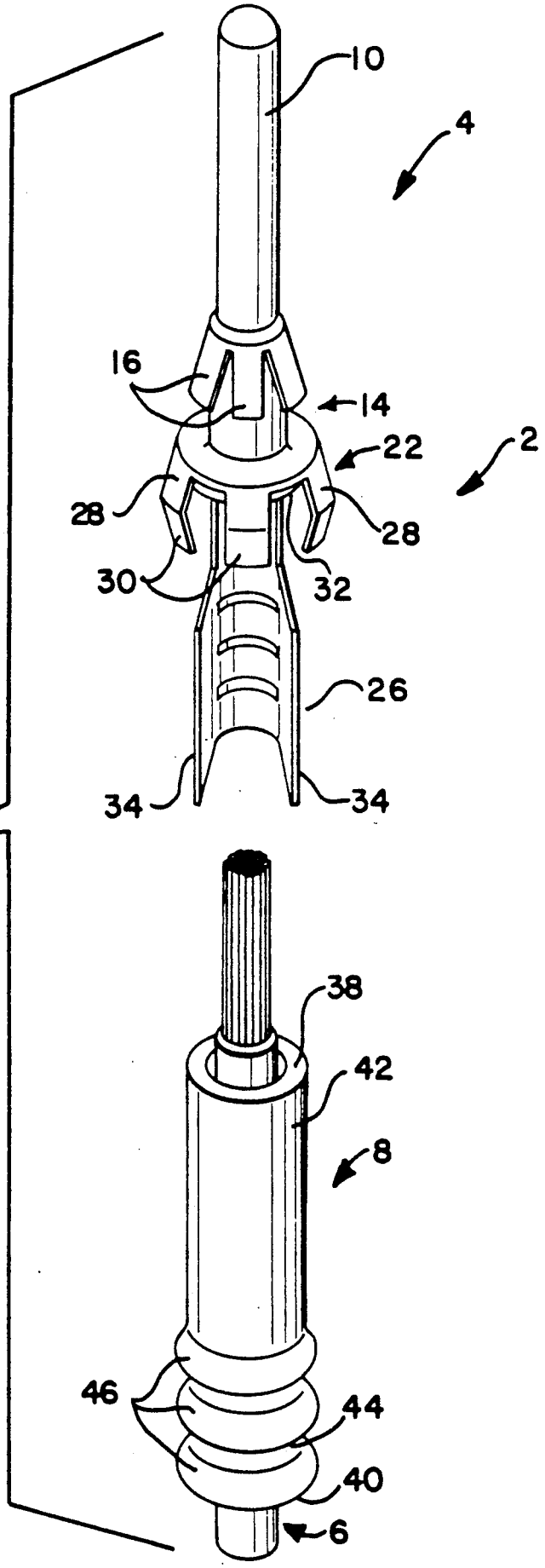
FIG. 1 is an isometric view of an electrical connector of the present invention showing the electrical terminal exploded away from the wire and the sealing means.
Figure 2:
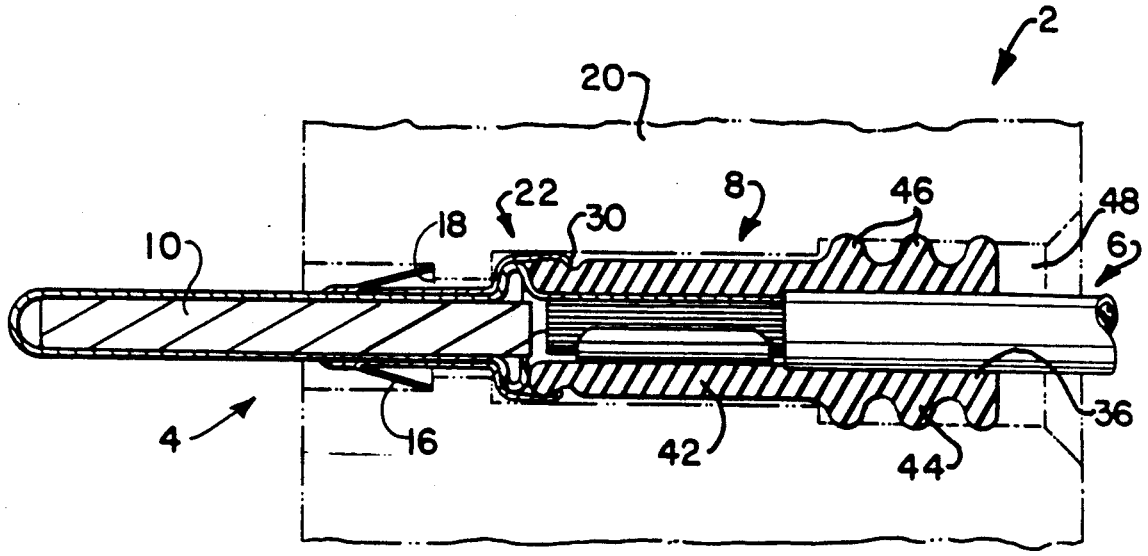
FIG. 2 is a cross-sectional view of the electrical connector, fully assembled, and positioned in a terminal receiving cavity of a housing means.
Figure 3:
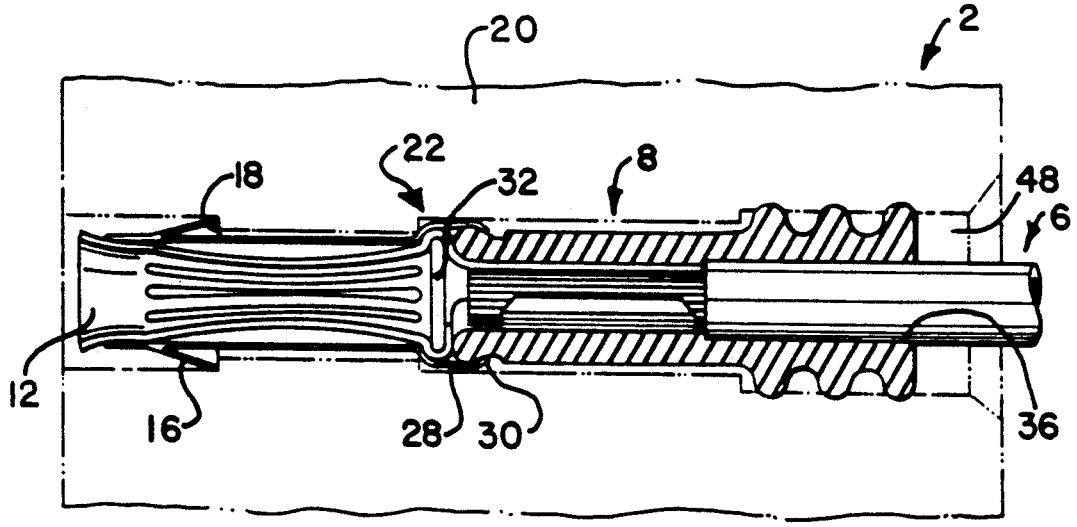
FIG. 3 is a cross-sectional view, similar to that of FIG. 2, showing an alternate embodiment of an electrical connector, fully assembled, and positioned in a terminal receiving cavity of a housing means.

As is best shown in FIG. 1, electrical connector 2 has an electrical terminal 4, a conductive cable 6, and a sealing sleeve 8. As can be seen in FIGS. 2 and 3, the electrical terminal can have various mating areas, without departing from the scope of the invention. In fact, FIG. 2 illustrates the mating area of the electrical terminal comprising a pin 10, while FIG. 3 illustrates a pin receptacle 12 in the mating area. For ease of explanation and understanding, only terminal 4 with pin 10 provided thereon will be discussed in detail. However, it should be noted that the operation and explanation of the terminal with the pin receptacle 12 is essentially identical.

As best shown in FIGS. 1 and 2, terminal 4 has pin 10 provided at the mating end thereof. A clamping portion 14 is provided adjacent the pin 10. The clamping portion has resilient locking arms 16 which extend from the clamping portion at an angle relative to the longitudinal axis of the pin. As best shown in FIG. 2, the resilient locking arms 16 are provided to cooperate with shoulders 18 of housing 20 to insure that the electrical connector 4 will be maintained in the proper position relative to the housing. This type of resilient locking feature is well known in the industry.

Figure 6:
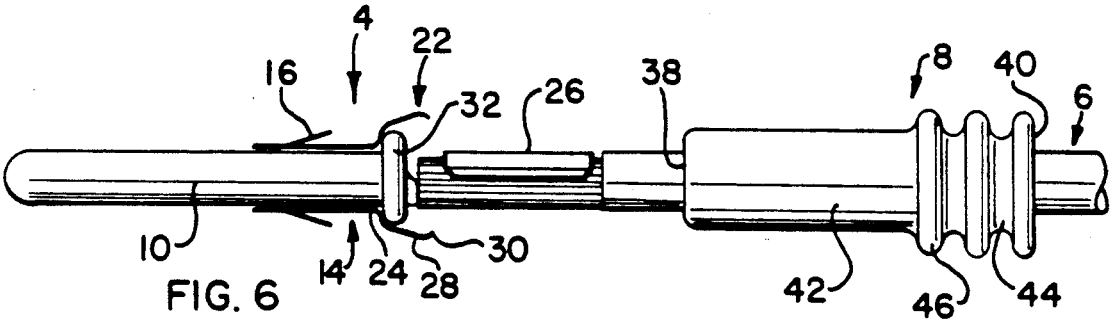
FIG. 6 is a view similar to FIG. 5, with the exception that the electrical terminal has been moved into electrical engagement with the exposed ends of the conductors.

Also provided on clamping portion 14 are clamping arms 22. As shown in FIGS. 1 and 6, clamping arms 22 are positioned proximate an end 24 of clamping portion 14 which is provided adjacent wire receiving member 26 of terminal 4. When clamping arms 22 are provided in their initial, unstressed position, intermediate portions 28 of the clamping arms extend from clamping portion 14 at an angle relative to the longitudinal axis of the pin. Free end portions 30 of clamping arms 22 are also bent at an angle relative to the intermediate portions of the clamping arms. The configuration of the clamping arms 22 allows the free end portions 30 to be bent around so that the free end portions 30 are positioned to extend toward the wire receiving member 26.

A collar 32 is provided proximate wire receiving member 26 and adjacent clamping arms 22. As is shown in FIG. 1, the diameter of collar 32 is greater than the diameter of pin 10.

Wire receiving member 26 is positioned proximate clamping portion 14. The wire receiving member extends in the opposite direction from clamping portion 14 as does pin 10. As is shown in FIG. 1, wire receiving member 26 has flanges 34 which extend in opposed directions, when the flanges are in their initial, unstressed positions. These flanges are deformed as cable 6 is terminated to the wire receiving member.

Figure 7:
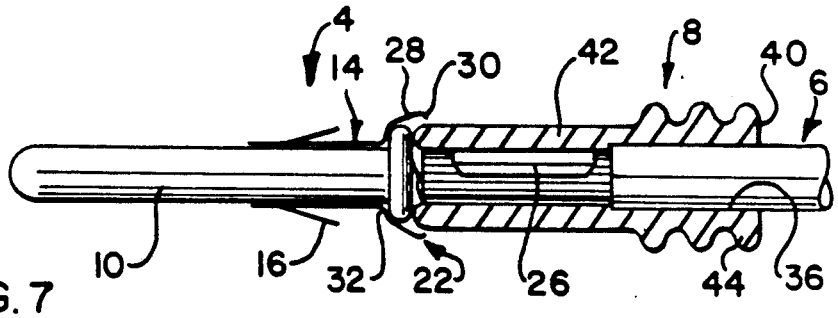
FIG. 7 is a view similar to FIG. 6, with the exception that the sealing means, shown in crosssection, has been moved to cover a portion of the electrical terminal and the exposed ends of the conductors.
Figure 8:
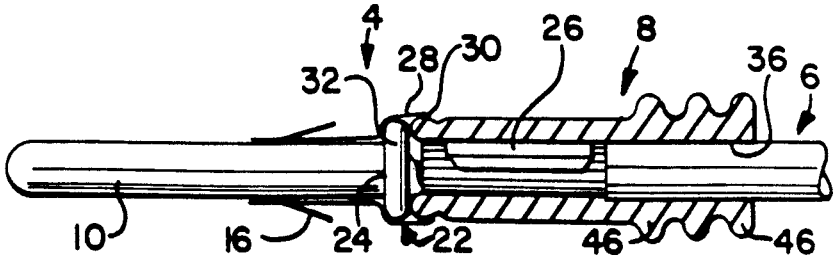
FIG. 8 is a view similar to FIG. 7, with the exception that locking means of the electrical terminal have been moved into cooperation with the sealing means, to maintain the sealing means in position.

Sealing sleeve 8 is made from any material having the elastic and dielectric characteristics required. As is best shown in FIGS. 7 and 8, sealing sleeve 8 has an opening 36 which extends from end 38 to opposed end 40. The diameter of opening 36 is such to allow cable 6 to be inserted therethrough. However, as is best illustrated in FIG. 2, the diameter of opening 36 is dimensioned to form a seal about cable 6. Therefore, after insertion of the cable in opening 36, the diameter of opening 36 may vary.

Referring back to FIG. 7, a first portion 42 of sealing sleeve 8 is provided with a relatively smooth outside surface, which has a generally consistent diameter. A second portion 44 of sealing sleeve 8 is provided adjacent first portion 42 and opposed end 40. Ridges 46 are provided on second portion 44 and extend circumferentially thereabout. Although three ridges 46 are provided in the embodiment shown, any number of ridges may be provided.

Housing 20, into which electrical connector 2 is provided has at least one terminal receiving cavity 48 which extends therethrough. As is shown in FIGS. 2 and 3, the diameter of the cavities varies according to the space requirements of the terminals inserted therein.

Figure 4:
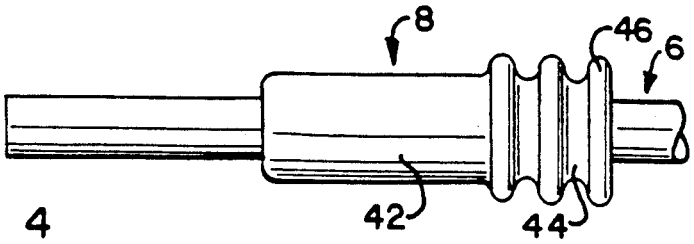
FIG. 4 is a side view of the wire with the sealing means provided thereon.
Figure 5:
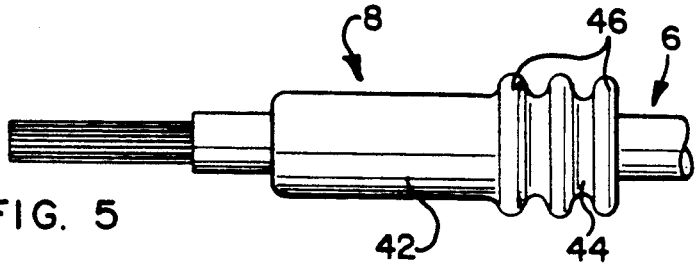
FIG. 5 is a view similar to FIG. 4, with the exception that the wire has a portion of the insulation removed to expose the conductors provided therein.

The assembly procedure for electrical connector is depicted in FIGS. 4 through 6. As only one terminal assembly is shown in the figures, the discussion provided will focus on one terminal. However, this procedure is applicable to all of the terminal assemblies.

Initially, sealing sleeve 8 is positioned on cable 6 (FIG. 4). In this position cable 6 extends through opening 36. The resilient nature of the material of which sleeve 8 is comprised allows the diameter of opening 36 to adjust to the diameter of cable 6.

With sleeve 8 is position on cable 6, an end of the cable is stripped of the insulation to expose the individual conductors provided therein (FIG. 5). Electrical terminal 4 is then positioned adjacent the exposed end of cable 6, as shown in FIG. 6. Clamping portion 14 of terminal 4 is crimped to the exposed conductors in any well known manner, causing the terminal 4 to be electrically and mechanically engaged to cable 6.

Once terminal 4 is mechanically and electrically engaged to cable 6, sleeve 8 is slid from the position shown in FIG. 6 of the position shown in FIG. 7. As this movement occurs, the diameter of opening 36 will change as portions of the opening is moved past the insulation of cable 6. This is due to the resilient nature of the material. In order to move sleeve 8, enough force must be applied to the sleeve in order to overcome the frictional engagement between the walls of opening 36 and the surface of cable 6. The amount of frictional force present is dependent upon the size of the opening and the material of which the sleeve is composed.

As is shown in FIG. 7, the movement of sleeve 8 is stopped when end 38 of sleeve 8 engages collar 32 of terminal 4. Sleeve 8 is temporarily maintained in this position by the frictional engagement between sleeve 8 and cable 6.

To secure sleeve 8 in position relative to terminal 4, it is important to have a positive retention feature, as the frictional force will not be adequate to maintain the sleeve in position over time. Therefore, clamping arms 22 are moved from an open position, shown in FIG. 7, to a closed position, shown in FIG. 8. In this closed position free end portions 30 of arms 22 deform sleeve 8. The configuration of free end portions 30 and the deformation of sleeve 8 insures that sleeve 8 will be retained in position.

Once terminal 4, cable 6, and sleeve 8 are secured together, the assembly is positioned in the terminal receiving cavity 48 of housing 20, as shown in FIG. 2. As is shown, the walls of the cavity prevent arms 22 from returning to the open position.

With the assembly positioned in housing 20, it is apparent that the air volume provided about the assembly is greatly reduced. In fact, sleeve 8 is configured to minimize the air volume provided in the cavity. Consequently, as the connector is exposed to temperature fluctuations, there is not enough air provided in each cavity to cause moisture to condense on the terminals. This is an important result because the condensation of moisture can cause corrosion of the terminals, as well as the exposed ends of the cable, which results in a very unstable electrical connection. Therefore, the present invention discloses a terminal assembly which has a much more reliable electrical connection.

It should be noted that the sleeve 8 provides a type of seal about crimping portion 14 and the exposed end of cable 6. This also helps to provide for a more reliable electrical connection.

Changes in construction will occur to those skilled in the art and various apparently different modifications and embodiments may be made without departing from the scope of the invention. The matter set forth in the foregoing description and accompanying drawings is offered by way of illustration only. It is therefore intended that the foregoing description be regarded as illustrative rather than limiting.

I claim:

1. An electrical terminal assembly (2) for use in the termination of an electrical conductor (6), the electrical terminal assembly (2) having a first end and an opposed second end, a mating portion (10) of the terminal assembly (2) is positioned proximate the first end of the terminal assembly, and a conductor engaging portion (26) is provided proximate the second end of the terminal assembly (2), the conductor engaging portion (26) having a conductor crimping means (34) which cooperates with the conductor (6) to provide the electrical interconnection between the conductor (6) and the terminal assembly (2), the electrical terminal assembly (2) being characterized in that:

insulating cover means (8) are provided which extend over the conductor engaging portion (26), the insulating cover means (8) having an opening (36) provided therein which allows the electrical conductor (6) and conductor crimping means (34) to be positioned in the opening (36), such that moisture condensation is prevented on the electrical conductor (6) and the conductor crimping means (34);

securing means (22) are provided on the electrical terminal assembly (2), the securing means have clamp arms which are movable between a first position and a second position, the second position having free ends (30) of the clamp arms (22) in cooperation with the insulating cover means (8) to maintain the insulating cover means (8) in cooperation with the conductor crimping means (34).

2. An electrical terminal assembly (2) as set forth in claim 1 characterized in that the securing means (22) have fixed ends which are provided on the mating portion (10) of the terminal assembly (2), and free ends (30) which extend from the fixed ends toward the second end of the terminal assembly (2).

3. An electrical terminal assembly (2) as set forth in claim 1 characterized in that the free ends (30) of the securing means (22) are bent at an angle relative to the fixed end, such that as the securing means (22) is moved to the second position, the free ends (30) of the securing means will engage the insulating cover means (8).

4. An electrical terminal assembly (2) as set forth in claim 1 characterized in that insulating cover means (8) has a first end portion (38) and a second end portion (40), the first end portion (38) provided adjacent the mating portion (10) of the terminal assembly (2), the second end portion (40) having a ridge provided circumferentially about the outside diameter of the electrical conductor (6).

5. An electrical terminal assembly (2) as set forth in claim 4 characterized in that the opening (36) provided in the insulating cover means (8) has a first diameter in the first end portion (38), and a second diameter in the second end portion (40), the first diameter being essentially the same as the diameter of the conductor (6) with insulation stripped away, and the second diameter being essentially the same as the diameter of the conductor with the insulation remaining, thereby insuring that only a minimal amount of air will be provided between the conductor and the insulating cover means (8).

6. An electrical terminal assembly (2) as set forth in claim 1 characterized in that the wire crimping means (34) is a U-shaped metal plate which is integrally attached and extends from the mating portion (10) of the terminal assembly.

7. An electrical terminal assembly (2) as set forth in claim 1 characterized in that the mating portion (10) has a pin contact section provided thereon.

8. An electrical terminal assembly (2) as set forth in claim 1 characterized in that the mating portion (10) has a pin receiving contact section provided therein.

9. An electrical terminal assembly (2) as set forth in claim 5 characterized in that the electrical terminal assembly (2) is provided in a dielectric housing (20) which has terminal receiving cavities (48) which extend therethrough, the configuration of the insulating cover means (8) being dimensioned such that the insulating cover means (8) will be positioned in the cavities (48) in a manner so as to allow minimal air voids therein.

* * * * *